US007880630B2

(12) United States Patent
Stapleton

(10) Patent No.: US 7,880,630 B2
(45) Date of Patent: Feb. 1, 2011

(54) SECURITY SYSTEM FOR A BOUNDARY

(75) Inventor: Howard Stapleton, Mid Glamorgan (GB)

(73) Assignee: Compound Security Systems Limited, Cambridgeshire (GB)

( * ) Notice: Subject to any disclaimer, the term of this patent is extended or adjusted under 35 U.S.C. 154(b) by 695 days.

(21) Appl. No.: 11/571,686

(22) PCT Filed: Jul. 8, 2005

(86) PCT No.: PCT/GB2005/002698

§ 371 (c)(1),
(2), (4) Date: Jul. 27, 2007

(87) PCT Pub. No.: WO2006/005926

PCT Pub. Date: Jan. 19, 2006

(65) Prior Publication Data

US 2007/0296577 A1 Dec. 27, 2007

(30) Foreign Application Priority Data

Jul. 9, 2004 (GB) ..... 0415403.5
Sep. 14, 2004 (GB) ..... 0420467.3

(51) Int. Cl.
*G08B 21/00* (2006.01)

(52) U.S. Cl. ..... 340/644; 340/540; 340/541; 340/545.6; 340/550; 340/551; 340/552; 340/564; 340/565

(58) Field of Classification Search ..... 340/644, 340/540, 541, 545.6, 550, 551, 552, 564, 340/565

See application file for complete search history.

(56) References Cited

U.S. PATENT DOCUMENTS

| | | | | |
|---|---|---|---|---|
| 4,683,356 | A | 7/1987 | Stoler et al. | |
| 4,829,286 | A * | 5/1989 | Zvi | 340/541 |
| 5,578,990 | A | 11/1996 | Sanford, Jr. et al. | |
| 6,891,472 | B2 * | 5/2005 | Tallman | 340/541 |
| 2005/0017230 | A1 * | 1/2005 | Easley et al. | 256/10 |

FOREIGN PATENT DOCUMENTS

| | | |
|---|---|---|
| DE | 2717906 | 10/1978 |
| EP | 0363625 | 10/1990 |
| GB | 2016777 | 9/1979 |
| GB | 2171232 | 8/1986 |
| GB | 2349727 | 8/2000 |

OTHER PUBLICATIONS

PCT International Search Report for Application No. PCT/GB2005/002698 dated Oct. 7, 2005.
International Search Report for Application No. GB0514070.2 dated Sep. 12, 2005.

* cited by examiner

*Primary Examiner*—Tai T Nguyen
(74) *Attorney, Agent, or Firm*—Tumey L.L.P.

(57) ABSTRACT

A security system for a boundary is generally shown as (1) in FIG. 1. The components comprise an elongate member (2) and a support (3) for the bar. The bar support (3) can be fitted to boundary support. A conduit (7) extends through the housing (3). The rod is surrounded by a resilient member. The boundary supports (4) and the bars (2) are in communication with a circuit monitor unit (17) and from an electromechanical disturbance mechanism (EMDM) unit for detecting security breakdown of the boundary.

30 Claims, 3 Drawing Sheets

SECURITY SYSTEM FOR A BOUNDARY

CROSS-REFERENCE TO RELATED APPLICATIONS

Figure 1:
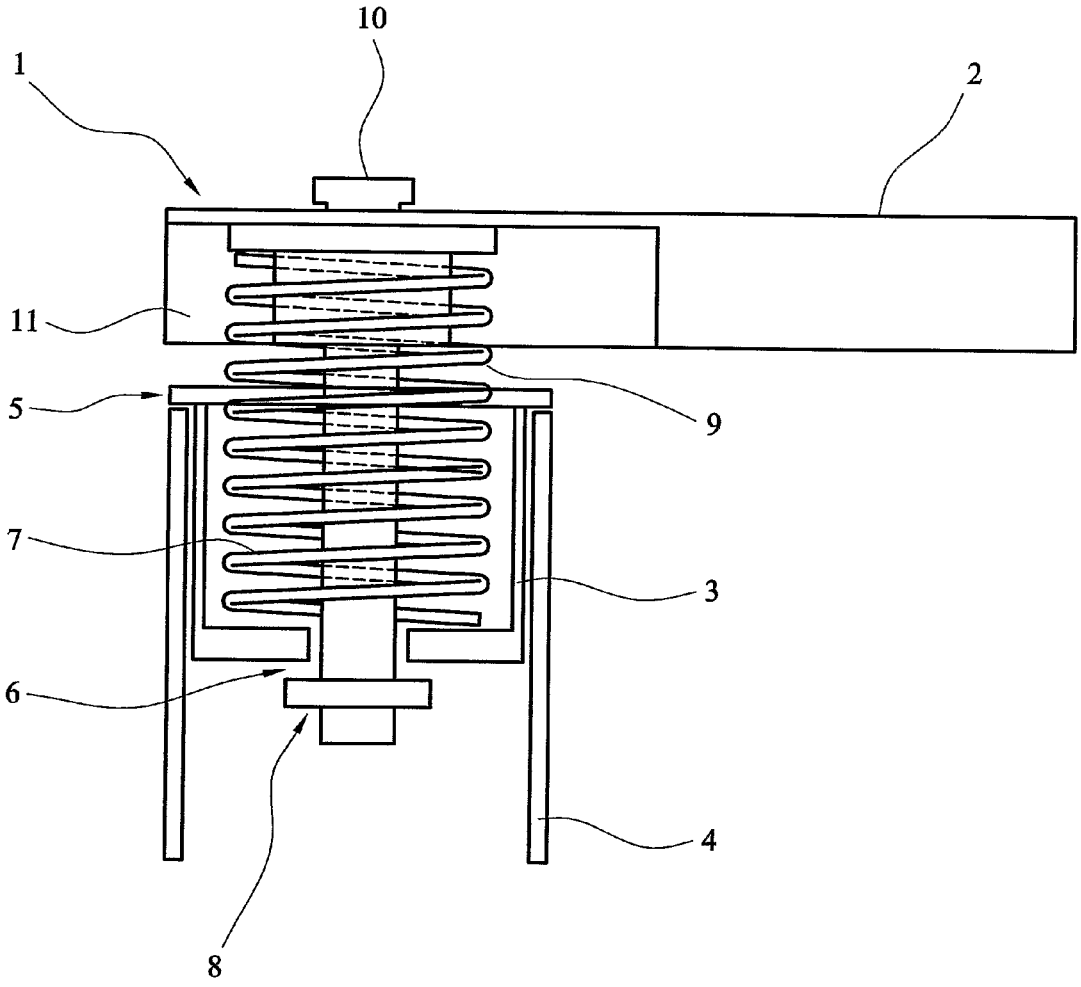

This application is a 371 application of PCT/GB2005/002698 filed Jul. 8, 2005, which claims priority to GB0415403 filed Jul. 9, 2004 and GB0420467 filed Sep. 14, 2004.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates to a security system for a boundary such as a perimeter fence.

2. Description of Related Art Including Information Disclosed Under 37 CFR 1.97 and 1.98.

Protection of boundaries such as fencing have always been a problem as intruders can scale or cut through boundaries made of wood or wire fencing. A common way of monitoring a boundary is to use closed circuit television (CCTV) systems. However, such systems are expensive to install and need a clear line of sight to the perimeter to adequately monitor the boundary. Other means to monitor a boundary is the use of passive infrared (PIR) detectors. However these passive systems suffer from high levels of false alarms due to triggering by animals or birds.

Other systems use wires including microphonic wiring or wires that are under tension which provide the intruder detector but these systems require substantial time to install and are therefore unsuitable for temporary installations.

Further systems have been developed where a number of electrically conductive straps are joined between metal fence posts with the straps being designed to break at a predetermined tension but such systems need re-setting each time the straps are broken which can increase costs and require manpower to replace broken straps.

BRIEF SUMMARY OF THE INVENTION

The current invention seeks to overcome problems associated with the prior art by providing a security system provided as modular units that can be used as or with existing boundaries such as fencing and which can be set to operate only when a true breach of a boundary occurs so avoiding false alarms. In addition the security system is both quick and easy to install/remove and yet provides a high level of detection of breaching of the boundary.

According to the present invention, there is provided a security system for a boundary as set out in claim 1. Preferably, the system comprises a bar to be positioned along a length of the boundary, and a support for the bar, wherein the support comprises a housing, positionable along the boundary, the housing including a conductive rod held in position by a resilient member that allows the rod to move within the housing, wherein, when the system is in a neutral state, where the bar is in a predetermined position, a threshold electrical parameter is detected by a monitoring system connected to the security system and no alarm is activated but when there is movement of the bar creating an electrical parameter above or below the threshold electrical parameter, the system causes an alarm to be activated to indicate that a breach of the security system has occurred.

Preferably, the electrical parameter is a current flow between the bar and the housing. The current flow is as a result of contact between the bar and the housing which results from movement of the bar. This allows the system to switch between a passive state where no alarm is activated to an active state where the alarm is activated.

In an alternative embodiment, the electrical parameter is resistance between the bar and the housing. Preferably, the system includes a resistance detector.

It is also envisaged that in a further embodiment, capacitance between the bar and the housing is detected and preferably the system also includes a capacitance detector. In such an arrangement AC current flows through the system and causes a capacitance that is detected.

In a preferred arrangement, the bar is fixed to the top of an existing boundary such as a fence. However, it is envisaged that a series of bars or even one bar could provide the boundary fence. If there are a series of bars, these are positioned in a vertical array to create the boundary. If one of the bars is moved, this causes an alarm to be activated. The system may also be arranged such that the alarm will be activated only if for example a set number of bars are moved. By having a system which can only be activated when a defined number of bars are moved, this provides an increased degree of protection against inadvertent operation of the alarm because a distinction can be made between the weight of say a bird or animal resting on a bar and a human depressing or lifting a bar.

It is envisaged that the bar is provided as a solid body, extending between a pair of supports. One of the supports may have the housing as previously described, including a detector for movement of the bar, while the other support may be a known support which simply acts to hold the bar in position. However, it is also envisaged that both supports can include what may be described as an "active housing" to detect movement of the bar. In a further arrangement, each of the supports may include a movement detector so a comparison can be made between movement points on a bar and this data can be recorded and used to analyse if there are more attempted breaches on one point along a boundary as compared with another point.

In an alternative arrangement, the bar can be provided as a semi rigid or a rigid body having areas of flexibility along its length. This allows the bar to be shaped so that it can follow the boundary perimeter, for example if the boundary is non-linear. In such arrangements, as for the solid bar arrangement, the bar is conductive and may have either a conductor connected to the bar or running through the bar.

Preferably, a series of bars are positioned adjacent one another to provide a boundary length. It is envisaged that in such an arrangement, the bars and/or conductors are electrically connected to one another, for example by a galvanic connection.

In a preferred arrangement, the conductive rod is electrically isolated from the bar. The connecting rod is held within a resilient element, which may be a spring or a compressible material such as a resilient polymer or rubber element.

In "normal" use i.e. when the alarm is not activated, the conductive rod and the bar are electrically isolated from one another. This may be by having the rod attached to an area of the bar which is formed from an insulating material e.g. nylon.

In a preferred arrangement, the rod is secured to the bar by a bolt which itself is attached at one end to the rod. The rod passes through the resilient material, in a substantially vertical direction and terminates in a fixing element which ensures that the rod is held in position relative to the housing. The fixing element may be a bolt or nut or other expanded member which prevents the rod which extends from an aperture in the housing from moving relative to the support housing.

Preferably, the resilient material is a spring or it is a body of material having an inherent "resilience" such as rubber or an expandable/contractible polymer based material.

In a preferred arrangement, the conductive rod passes through the resilient material and out through the housing, wherein a securing member is attached to an end of the rod, outside the housing with the securing member being moveable between a locked position, where the rod is fixed in relation to the housing and a moveable position, where the rod can move relative to the housing. In such an arrangement, the rod and consequently the housing is lockable to a support such as a boundary upright e.g. a fence post. By having the facility to lock the housing to a boundary support, this provides an added security feature whereby the security system is less likely to be tampered with or removed from a boundary.

It is preferred that the security system is connectable to an existing monitoring system for a security system. The monitoring system may include CCTV, alarm and or recordal systems of activities around the boundary.

The security system may include a time recordal system whereby movement of the bar is recorded over a set period of time and if the movement falls outside or within predetermined parameters, an alarm is activated by having a time delay for activation of the alarm, this adds to the facility for distinguishing between an active breach of the security system and an accidental contact with the system, for example if a person accidentally brushes against a bar while walking past it.

It is envisaged that the alarm may be an integral part of the security system. However, the security system can be used with existing monitoring and/or alarm systems. It is envisaged that a visible and or an audible alarm can be activated, for example lights can flash when a breach occurs as well as an audible alarm to warn the would be intruder that their presence has been detected. In such an arrangement, the alarm may become apparent to the intruder. Alternatively a "silent" alarm can be activated which will be relayed either to a security guard or the police so that an intruder can be apprehended without them becoming aware that their presence is detected. A silent system has particular advantages where break ins/breaches have been monitored over a period of time and an offender needs to be apprehended.

Further, the bar or bars used in the boundary may have further features, for example, one or more bars may be electrified to provide an electrified boundary that would act as a further deterrent to would be intruders.

A particular advantage of the present invention is that it provides for different degrees of security monitoring and differentiation between security breaches. For example, as movement of the bar is monitored relative to the support, a control can be included to detect passive activation of the security systems as compared with all attempted breach. An attempted breach would occur on a shorter time scale due to activation of an alarm which makes an intruder leave the scene as compared with an active breach where an intruder is aware that an alarm has been activated but still attempts to remove goods surrounded by the boundary before security staff or police appear to apprehend the intruder.

It is further envisaged that the security system as discussed can be retro-fitted to existing boundaries e.g. fences. However, the system can be sold as part of a boundary or the security system can itself provide the boundary, especially if there is a series of vertically arranged bars.

BRIEF DESCRIPTION OF THE SEVERAL VIEWS OF THE DRAWING(S)

Figure 2:
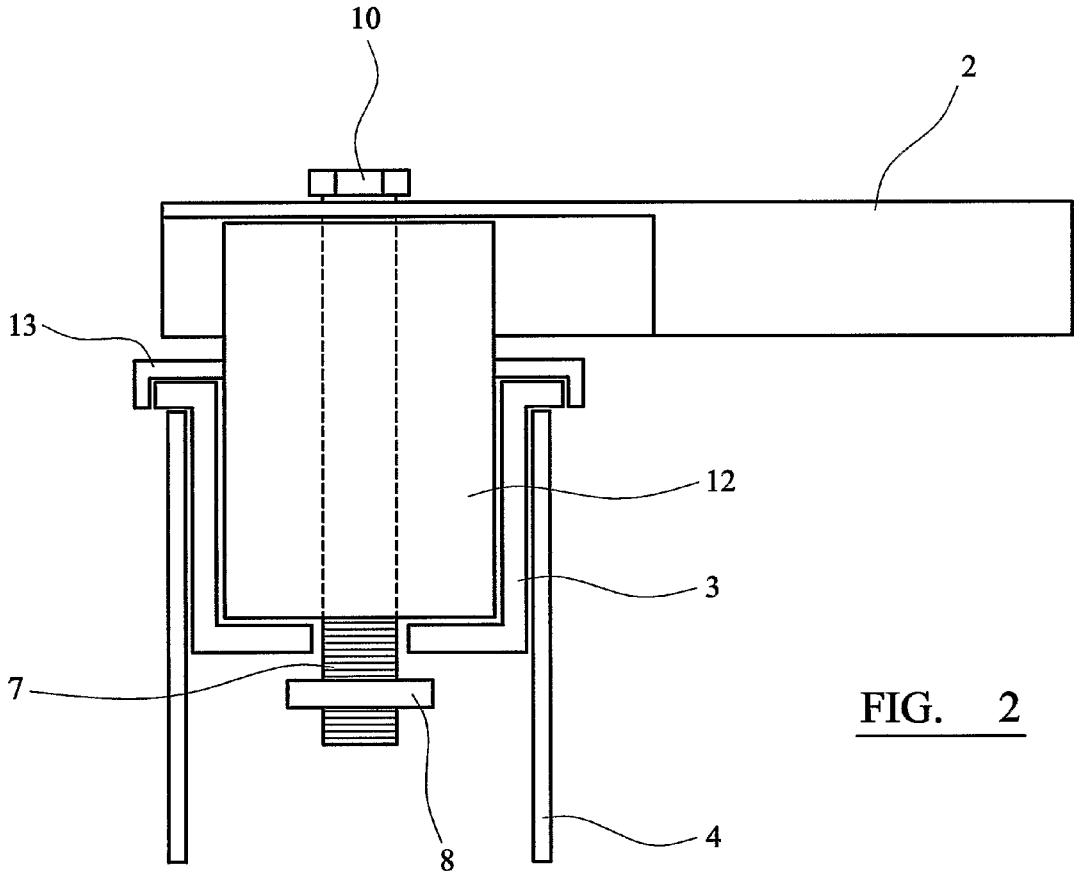
Figure 3:
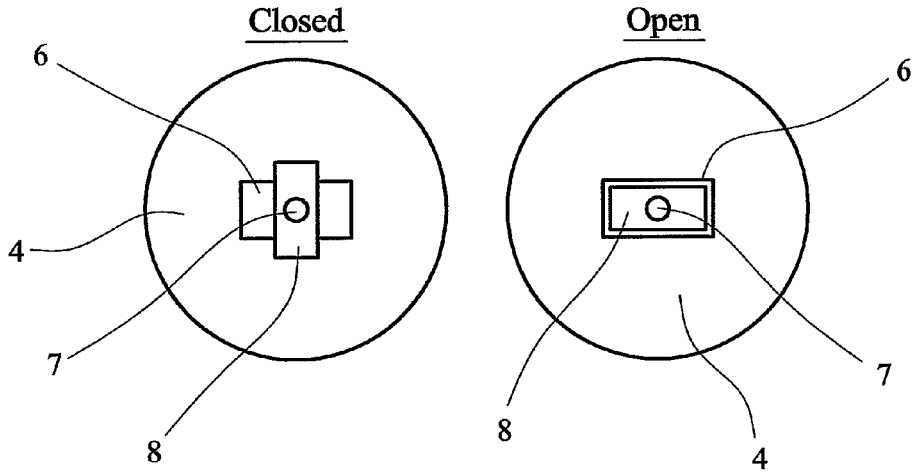

An embodiment of the invention will now be described by way of example only, with reference to and as illustrated in the accompanying Figures in which:

FIG. 1: shows a side view of a bar and support according to an embodiment of the invention, where the resilient member is a spring;

FIG. 2: shows a side view of a support and bar where the resilient member is a rubber bung;

FIG. 3: shows a view from below of a locking member at the base of a housing for a support; and FIG. 4: shows a series of fence panels across which several bars extend.

DETAILED DESCRIPTION OF THE INVENTION

The main components of a security system for a boundary are generally shown as 1 in FIG. 1. The components comprise a bar 2 and a support for the housing 3. The housing 3 can be fitted within a boundary support such as a fence tube 4. The support may either be slotted into the top of a fence tube and locked in position by locking on a receiving mechanism or by being secured into place, or alternatively it may be attached to a boundary support, for example a bracket or extension on the support 4.

The housing is generally of a cup shape having an upper cover 5 with an aperture in the upper cover. The base of the housing also includes an aperture 6 which is in alignment with the upper aperture 5. A bar 7 extends through the housing 3 and project beyond the aperture 6 at the base of the cup and the aperture in the upper cover 5. There is a securing member, which in this case is a rod 8 which is secured to the bar 7 in the region where in projects from the housing 3. The rod is prevented from being pulled from the housing when pulled in an upward direction. The rod is surrounded by a resilient member which in FIG. 1 is shown as a spring 9. The spring is a helical spring which extends along the length of the rod. The rod is attached to the bar 2 by way of a fixing member 10 which is shown as a nut which is secured to the rod on the opposite end to that which extends from the housing. The rod which passes through the housing extends through the bar so that the support and bar are held together. The portion of the rod extending through the bar passes through an area of the bar which includes an insulator 11, for example a nylon insulator. The insulator isolates the bar, which includes a conductive element from the housing 3 and support. It is only when the bar 2 is pushed downwards and the rod comes into contact with either the spring or if the bar is pushed upwards the rod 8 comes into contact with the base of the housing that there is contact which will act as an electrical switch which can be detected by a monitoring system. Because the rod is held by a resilient member, movement of the bar in either a sideways, upwards or downwards direction (XYZ) can be detected through contact of the rod with the housing or the spring contained within the housing.

FIG. 2 shows an alternative version of the arrangement shown in FIG. 1 where rather than a helical spring, a rubber component 12 sits in the housing and surrounds rod 7. A rubber capping 13 is positioned over the housing 3 which acts to isolate the bar 2 from the housing and hence the fence support 4 which is attached to a monitoring circuit.

FIG. 3 shows how the rod 7 can be locked onto a support 4. The base of the housing 4 has an aperture 6 as shown. As shown, the aperture in this case is of a rectangular shape. The aperture is preferably of a shape to match dimensions of the fixing member 8 that is attached to the end of a rod 7 which passes through the fixing member 8. When the rod is not locked onto the fence, i.e. when it is in the open position, the fixing member 8 can pass through the aperture as it matches the aperture dimensions. If the fixing member and rod is turned through 90°, as shown in the closed arrangement, the rotation of the fixing member 8 out of alignment with the aperture causes the fixing member 8 to be locked against the underside 4 of the housing. Consequently, the rod can not be pulled out of the housing as the edges of the fixing member 8 will abut against the underside 4 of the housing. This is an added security feature that prevents the security system from being tampered with as the rod and housing are locked together thereby securing the bar along a boundary where it is positioned.

Figure 4:
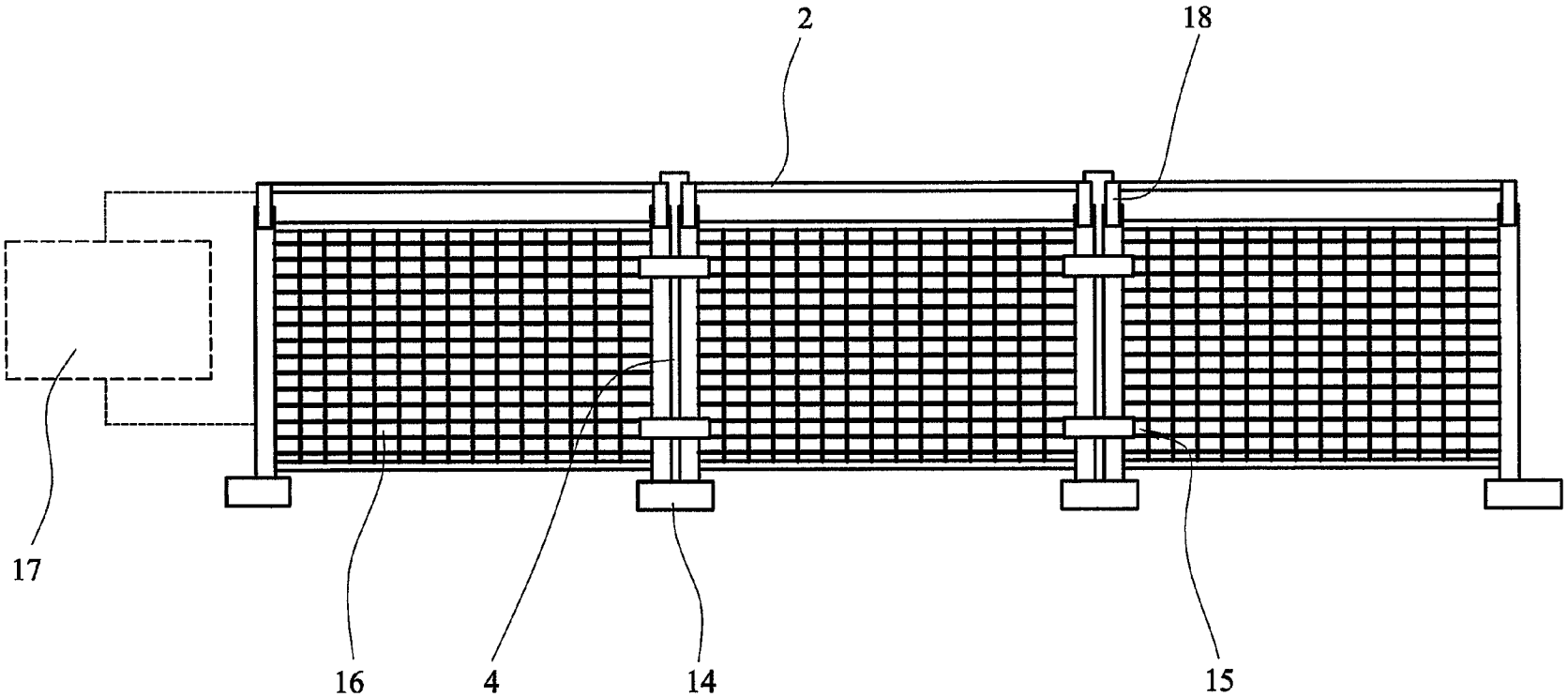

As shown in FIG. 4, a series of bars can be fixed atop a number of fence posts 4 which run along the length of a boundary. The fence posts are secured by supports 14 and fence panels 16 are held on the supports by clamps 15. A series of clamps extending vertically up the support hold the fence panels in an upper and lower region. The supports 4 and the bars 2 are in communication with a circuit monitor unit 17. The series of bars 2 are each supported at the top of a support 4 using the housing 3, rod 7 and resilient member 9 arrangement. Collectively, when secured to a bar 2, these components can be described as forming an electromechanical disturbance mechanism (EMDM) unit. The bars are connected to one another by a galvanic link 18 which completes the contacts between adjacent bars 2.

By having such a system, where individual fence panels include a metallic element as well as the clamp 15 being of metal, a continuous circuit along the boundary can be made which can be monitored by the circuit monitor 17. The fence and panels can form one part of the monitored circuit which can detect whether the fence itself is being pushed against while the bar and housing arrangement at the top of the fence can act as a secondary monitoring unit which detects whether a person has tried to climb over the fence because movement of the bar relative to the housing will be detected.

In addition to the monitoring arrangement as shown, the circuit can include warning mechanisms, for example visible systems including LEDs on the bar or associated with the fence which can flash a warning if a breach of the fence is attempted. In addition or as an alternative to a visible warning, an audible warning may be sounded when tampering or breach of the boundary is made. It is also envisaged that the system may be linked to an alarm system, either a silent alarm or an audible alarm which alerts people to an attempted break in of an area surrounded by the boundary and people can be despatched to apprehend such persons. This arrangement is particularly useful where high value goods are surrounded by the boundary, for example on building sites, in boatyards, or in car and vehicle compounds.

It will be appreciated that the boundary system can be erected quickly and easily, complete with a security system. The system can be sold as a retro-fit unit or in conjunction with a fencing system where the housing is already retro-fitted in a support and the bars can be attached to the support 4 via a securing mechanism such as a rod 7. Not only is the security system easy to assemble but it can also be moved quickly and re-erected at another position if required.

The invention is envisaged as covering all combinations of features described and aspects and embodiments discussed. It will be apparent that modifications and variations of the invention can be made without departing from the scope of the invention as described.

What is claimed:

1. A security system for a boundary, the system comprising an elongate member to be positioned along a length of the boundary, and a support for the elongate member, wherein the support includes a housing, the housing including a rod associated with the elongate member, said rod being held in position by a securing member that allows the rod to move within the housing, wherein, when the system is in a neutral state, where the elongate member is in a first position relative to the rod, a threshold parameter is detected by a monitoring system connected to the security system and no alarm is activated but when there is movement of the elongate member relative to the rod, creating a parameter above or below the threshold parameter, the monitoring system causes an alarm to be activated to indicate that a breach of the security system has occurred.

2. A security system according to claim 1, wherein the threshold parameter is an electrical parameter and the rod is a conductive rod.

3. A security system according to claim 1, wherein the rod and housing form a switch whereby when the elongate member is in a first position, no activation of the alarm occurs, but when the elongate member is moved, a threshold parameter is detected by the monitoring system and an alarm is activated.

4. A security system according to claim 1, wherein the elongate member is a bar.

5. A security system according to claim 1, wherein the elongate member comprises a series of bars positioned in either a substantially vertical or substantially horizontal array.

6. A security system according to claim 1, wherein the elongate member is provided as a semi rigid or a rigid body having areas of flexibility along its length to allow the member to be shaped so that it can follow the boundary perimeter.

7. A security system according to claim 2, wherein the electrical parameter is selected from one or more of;

a) current flow between the elongate member and the housing, b) resistance between the elongate member and the housing, c) capacitance.

8. A security system according to claim 1, wherein the housing is generally cup shaped, having a substantially vertical elongate aperture for receiving the conductive rod.

9. A security system according to claim 8, wherein the housing includes a resilient member within the aperture for supporting the conductive rod.

10. A security system according to claim 9, wherein the resilient member is an elastomeric member or a spring.

11. A security system according to claim 1, wherein the housing is secured to a boundary member positioned along the boundary for supporting the elongate member.

12. A security system according to claim 11, wherein the housing is positioned within an aperture in the boundary member.

13. A security system according to claim 12, wherein the housing is locked in position on the boundary member by way of a fixing element.

14. A security system according to claim 13, wherein the fixing element comprises a locking member that is releasably secured to the rod and which can be rotated to lock and unlock the rod and/or housing in position on the boundary member.

15. A security system according to claim 11, including one or more boundary members, and wherein one or more of the boundary members includes a movement detector.

16. A security system according to claim 15, wherein the movement detector(s) is linked to a control that can monitor and/or compare movements of elongate members along a boundary to locate points of security breach along the boundary.

17. A security system according to claim 1, wherein the alarm is activated when a predetermined number of bars are moved.

18. A security system according to claim 1, wherein the elongate members and/or conductors are electrically connected to one another by a galvanic connection.

19. A security system according to claim 1, wherein the rod is electrically isolated from the elongate member.

20. A security system according to claim 19, wherein the rod is positioned adjacent an area of the elongate member which is formed of an insulating material.

21. A security system according to claim 1, wherein the rod passes through an aperture in the elongate member and is releasably secured thereto by a releasable attachment means.

22. A security system according to claim 21, wherein the releasable attachment means comprises a member selected from a bolt, a nut or an expandible fixing member which substantially prevents the rod from moving relative to the housing.

23. A security system according to claim 1, wherein a control is connected to the monitoring system.

24. A security system according to claim 23, wherein the monitoring system is selected from one or more of a Closed Circuit Television System, an alarm system, a time recordal system or a video recordal system.

25. A security system according to claim 24, including a time delay mechanism for activating an alarm.

26. A security system according to claim 25, wherein the alarm is a visible and/or an audible alarm.

27. A security system according to any claim 1, wherein the alarm is a silent alarm.

28. A security system according to claim 1, wherein the boundary is electrified.

29. A security system according to claim 1, wherein the security system is adapted to be retro-fitted to existing boundaries.

30. A security system according to claim 29, wherein the existing boundaries comprise fences.

* * * * *